US006564386B2

(12) United States Patent
Fujikawa et al.

(10) Patent No.: US 6,564,386 B2
(45) Date of Patent: May 20, 2003

(54) DISPOSABLE SURGICAL GOWN OF BACK-CLOSABLE TYPE

(75) Inventors: Michiyo Fujikawa, Kagawa-ken (JP); Akiko Saito, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 0 days.

(21) Appl. No.: 10/054,912

(22) Filed: Jan. 25, 2002

(65) Prior Publication Data

US 2002/0095709 A1 Jul. 25, 2002

(30) Foreign Application Priority Data

Jan. 25, 2001 (JP) ..... 2001-16895

(51) Int. Cl.[7] ..... A41B 13/12

(52) U.S. Cl. ..... 2/51; 2/114; 2/321; 24/200; 24/198

(58) Field of Search ..... 2/114, 69, 51, 2/52, 901, 902, 904, 311, 312, 321, 336; 24/198, 200, 176, 186, 74 A, 23 B, 67.9

(56) References Cited

U.S. PATENT DOCUMENTS 3,843,971 A * 10/1974 Delanty et al. ..... 2/114
3,864,757 A * 2/1975 Hartigan ..... 2/51
4,019,207 A * 4/1977 Newman et al. ..... 2/51
4,290,148 A * 9/1981 Roberts ..... 2/51
4,369,527 A * 1/1983 Paul ..... 2/51
4,370,782 A * 2/1983 Aronica ..... 2/114
4,371,986 A * 2/1983 Wichman ..... 2/51
4,451,931 A * 6/1984 Wichman ..... 2/51
4,982,448 A * 1/1991 Kogut ..... 2/51
5,140,708 A * 8/1992 Burns ..... 2/51
6,049,907 A * 4/2000 Palomo ..... 2/51

FOREIGN PATENT DOCUMENTS

JP 6-207301 7/1994

* cited by examiner

*Primary Examiner*—Gloria M. Hale
(74) *Attorney, Agent, or Firm*—Clark & Brody

(57) ABSTRACT

A disposable surgical gown of back-closable type includes a basic body composed of a front body, first and second rear bodies separated from each other and a pair of sleeves. The first and second rear bodies are in advance developed in a circumferential direction and folded back onto the front body so that free side edge regions of the rear bodies lie on the outer surface of the front body. The free side edge regions are connected to each other by a tape member which has its transversely opposite side regions bonded to the respective free side edge regions at longitudinally middle zones thereof so as to extend in the circumferential direction and a perforation extending in a longitudinal direction between the opposite side regions along which perforation 16 the tape member may be cut off in two in the circumferential direction.

4 Claims, 12 Drawing Sheets

DISPOSABLE SURGICAL GOWN OF BACK-CLOSABLE TYPE

BACKGROUND OF THE INVENTION

This invention relates to a disposable surgical gown of back-closable type.

Japanese Patent Application Publication No. 1994-207301A discloses a disposable surgical gown of back-closable type comprising a basic body consisting of a front body and first and second rear bodies separated from each other in a circumferential direction with respect to a wearer's torso, a pair of sleeves attached to a pair of shoulder regions, respectively, and first and second belt strips adapted to bind the first and second rear bodies together. In the case of this well known gown, respective ends of the first and second belt strips are connected to the gown in a range extending from right or left lateral trunk to the backside and a belt loop for the first belt strip is provided in a range extending from left or right lateral trunk to the backside. Upper peripheries of the first and second rear bodies defining together a neck hole are provided with a hook member and a loop member adapted to be detachably engaged with each other, respectively. This gown is used in medical site by a wearer such as a surgeon, a nurse or other staff.

To wear this gown of well known, a wearer develops the first and second rear bodies to the circumferential direction so as to be spaced from each other in order to open the backside and, after the arms have been inserted into the respective sleeves, places the first and second rear bodies upon each other in order to close the backside. The wearer guides the first belt strip through the belt loop, then ties free ends of the first and second belt strips together, and finally engages the hook member with the loop member to close the neck hole. With this well known gown, the first and second rear bodies must be developed in the circumferential direction when the arms are inserted into the respective sleeves and handling of the gown is correspondingly troublesome. In addition, there is an anxiety that the wearer's cloths and skin not sterilized might come in contact with the outer surfaces of the respective rear bodies and exposed to various germs.

SUMMARY OF THE INVENTION

It is an object of this invention to provide a disposable surgical gown of back-closable type wherein it is unnecessary for a wearer to develop first and second rear bodies in a circumferential direction so as to be spaced from each other when the gown is actually worn and respective outer surfaces of these rear bodies are reliably prevented from coming in contact with cloths and skin of the wearer.

According to this invention, there is provided a disposable surgical gown of back-closable type comprising a basic body composed of a front body, first and second rear bodies separated from each other in a circumferential direction with respect to wearer's torso and a pair of sleeves connected to a pair of shoulder regions of the basic body, respectively.

The disposable surgical gown further comprises the gown is offered in a state prior to actual use thereof such that the first and second rear bodies are developed in the circumferential direction so as to be spaced from each other and folded back onto the front body so that respective free side edge regions of these rear bodies extending in a longitudinal direction may lie on the side of the outer surface of the front body, and the free side edges are connected to each other by a tape member extending in the circumferential direction and having its transversely opposite side regions bonded to the free side edge regions at longitudinally middle zones of the free side edge regions wherein a perforation extends across the tape member in the longitudinal direction between the transversely opposite side regions so that said tape member may be separated along the perforation in the circumferential direction.

According to one preferred embodiment of this invention, the tape member has a transversely middle zone extending in the circumferential direction between the transversely opposite side regions and, on both sides of the middle zone, a pair of perforations extend in the longitudinal direction so that the middle zone may be cut off from the transversely opposite side regions along the perforations.

According to another preferred embodiment of this invention, the gown is provided with a female fastener member and a male fastener member adapted to be detachably engaged with each other to fasten the first and second rear bodies together and wherein the female fastener member is attached to the basic body at an appropriate location in its longitudinally middle region while the male fastener member is attached to one of the transversely opposite side regions of the tape member.

According to still another preferred embodiment of this invention, the female fastener member is one of a hook member and a loop member constituting together so-called mechanical fastener and the male fastener member is the other.

DETAILED DESCRIPTION OF THE PREFERRED EMBODIMENTS

Details of a disposable surgical gown of back-closable type according to this invention will be more fully understood from the description given hereunder with reference to the accompanying drawings.

Figure 1:
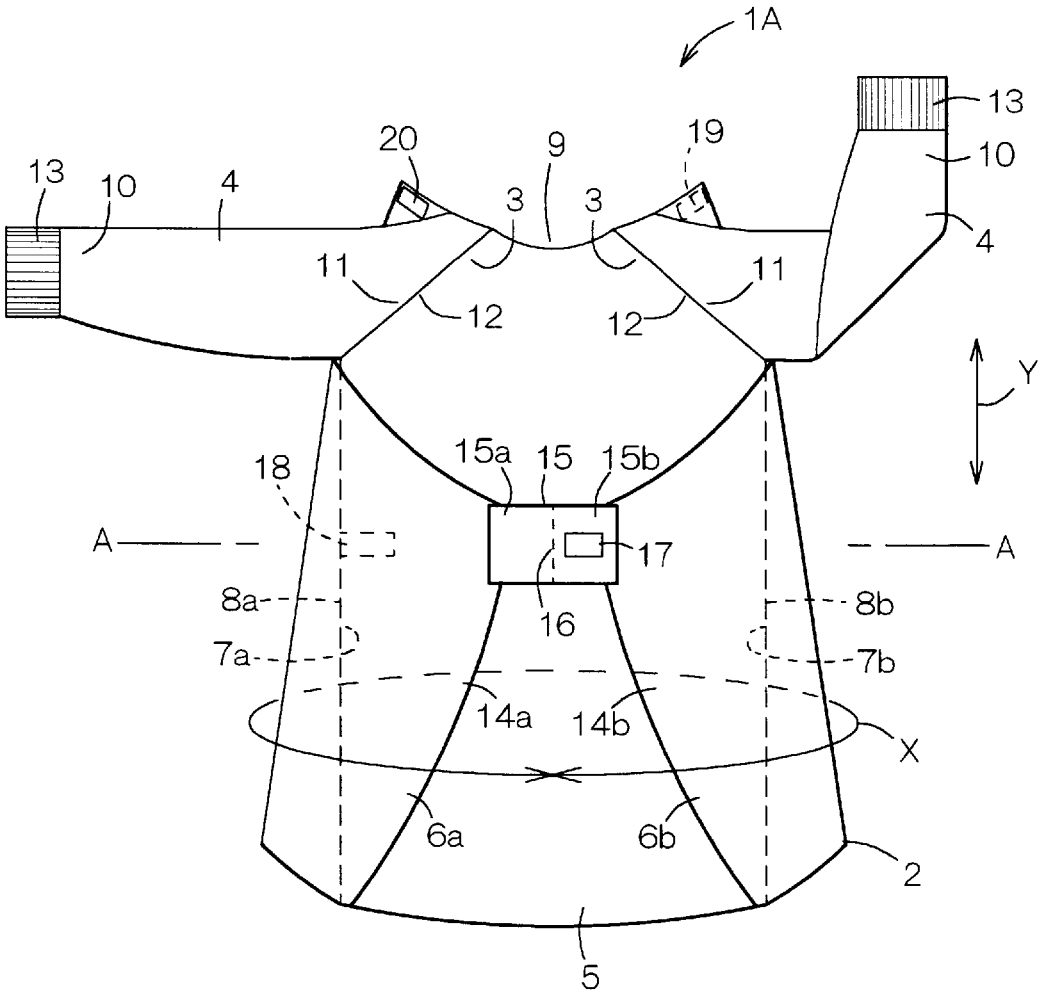
FIG. 1 is a perspective view showing an embodiment of the disposable surgical gown as viewed from the side of its front body.
Figure 2:
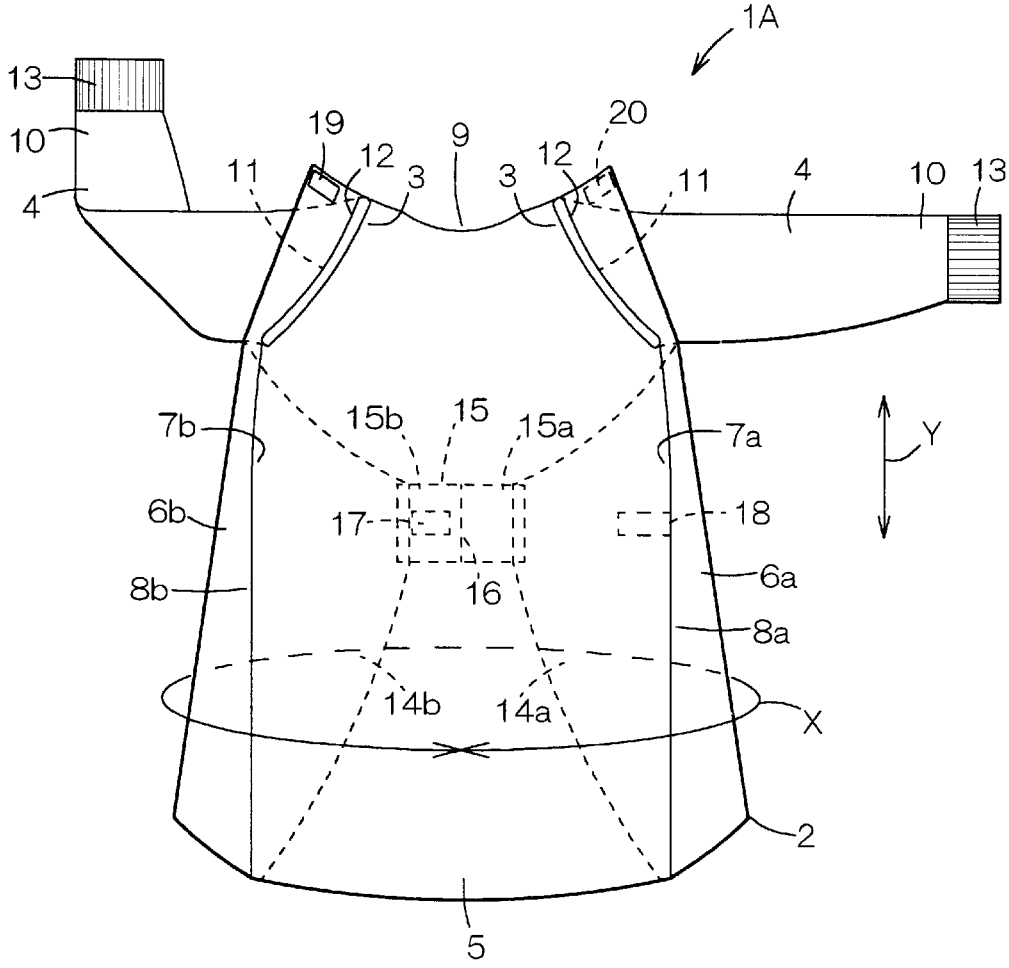
FIG. 2 is a perspective view showing the same gown as viewed from the side of its rear body.
Figure 3:
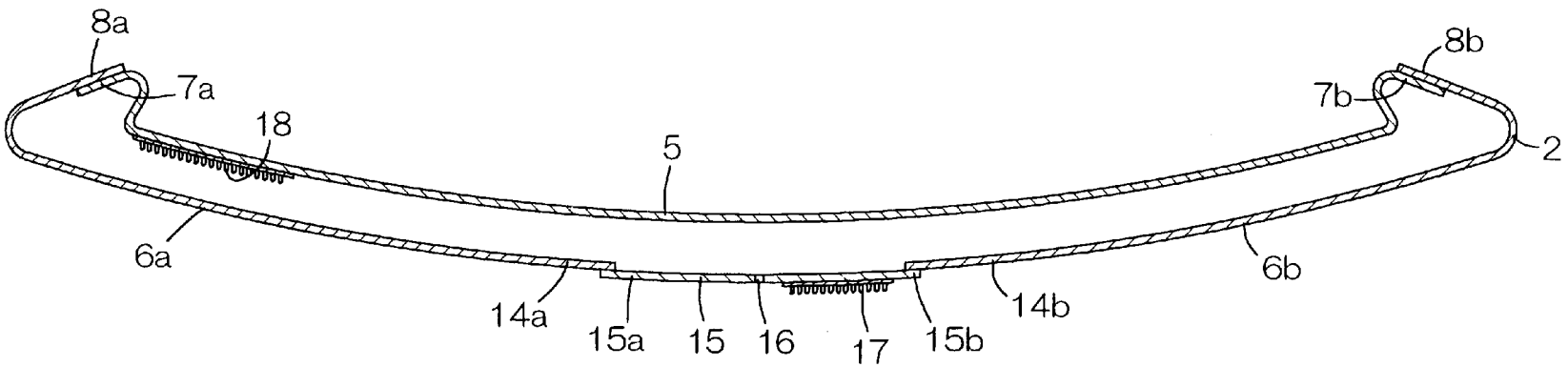
FIG. 3 is a cross-sectional view taken along the line A—A in FIG. 1.

FIG. 1 is a perspective view showing an embodiment 1A of a disposable surgical gown as viewed from the side of its front body 5, FIG. 2 is a perspective view showing the same gown 1A as viewed from its back and FIG. 3 is a cross-sectional view taken along the line A—A in FIG. 1 with its wearer's body on the left side of the front body 5. Referring to FIGS. 1 and 2, a circumferential direction with respect to a wearer's waist is indicated by a double-headed arrow X and a longitudinal direction with respect to the wearer's body is indicated by a double-headed arrow Y. Surfaces of a front body 5 and first and second rear bodies 6*a*, 6*b* referred to herein as inner surfaces should be understood to be the surfaces facing a wearer's skin of the gown 1A. Surfaces of these bodies 5, 6*a*, 6*b* referred to herein as outer surfaces should be understood to be the surfaces facing away from the wearer's skin of the gown 1A. The gown 1A is worn by a medical staff-member such as a surgeon and a nurse during an operation.

The gown 1A comprises a basic body 2 which is relatively long in the longitudinal direction and a pair of sleeves 4 attached to respective shoulder regions 3 of the basic body 2. The basic body 2 comprises, in turn, the front body 5 and, the first and second rear bodies 6*a*, 6*b* separated from each other in the circumferential direction.

In the basic body 2, transversely opposite-side edge regions 7*a*, 7*b* of the front body 5 extending in the longitudinal direction are respectively bonded to respective fixed side edges 8*a*, 8*b* of the first and second rear bodies 6*a*, 6*b* so that the front body 5 may be integrally connected to the first and second rear bodies 6*a*, 6*b*. Between the shoulder regions 3 of the basic body 2, a neck hole 9 is formed.

Each of the sleeves 4 is tapered from its sleeve head seam 11 toward its lower sleeve edge 10 and a peripheral edge of the sleeve head seam 11 is bonded to a peripheral edge of an associated arm hole 12 of the basic body 2. The lower sleeve edge 10 is provided with a cuff 13 which is elastically stretchable in its circumferential direction.

Prior to actual use, the gown 1A is stored in such a state that the first and second rear bodies 6*a*, 6*b* are developed in the circumferential direction so as to be spaced from each other and folded back onto the front body 5. In this state, respective free side edge regions 14*a*, 14*b* of these rear bodies 6*a*, 6*b* extending in the longitudinal direction lie on the outer surface of the front body 5.

Between the respective free side edge regions 14*a*, 14*b* of the first and second rear bodies 6*a*, 6*b*, a tape member 15 extends in the circumferential direction to connect these free side edge portions 14*a*, 14*b* to each other. The tape member 15 lies in longitudinally middle zones of the free, side edge regions 14*a*, 14*b* of the first and second rear bodies 6*a*, 6*b* and has transversely opposite side regions 15*a*, 15*b*. The side region 15*a* is partially bonded to the free side edge region 14*a* of the first rear body 6*a* and the side region 15*b* is partially bonded to the free side edge region 14*b* of the second rear body 6*b*.

Between the opposite side regions 15*a*, 15*b* of the tape member 15, a perforation 16 extends in the longitudinal direction so that the tape member 15 may be separated in the circumferential direction in two. The tape member 15 retains the gown 1A in such a state as the first and second rear bodies 6*a*, 6*b* are folded back onto the front body 5 (i.e., the backside of the basic body 2 is opened in the circumferential direction).

The side region 15*b* of the tape member 15 is provided with a hook member 17 as one component of a so-called mechanical fastener. The side edge region 7*a* of the front body 5 is provided in its longitudinally middle zone with a loop member 18 adapted to be detachably engaged with the hook member 17. The first rear body 6*a* is provided at its upper part with a hook member 19 and the second rear body 6*b* is provided at its upper part with a loop member 20 adapted to be detachably engaged with the hook member 19.

Figure 4:
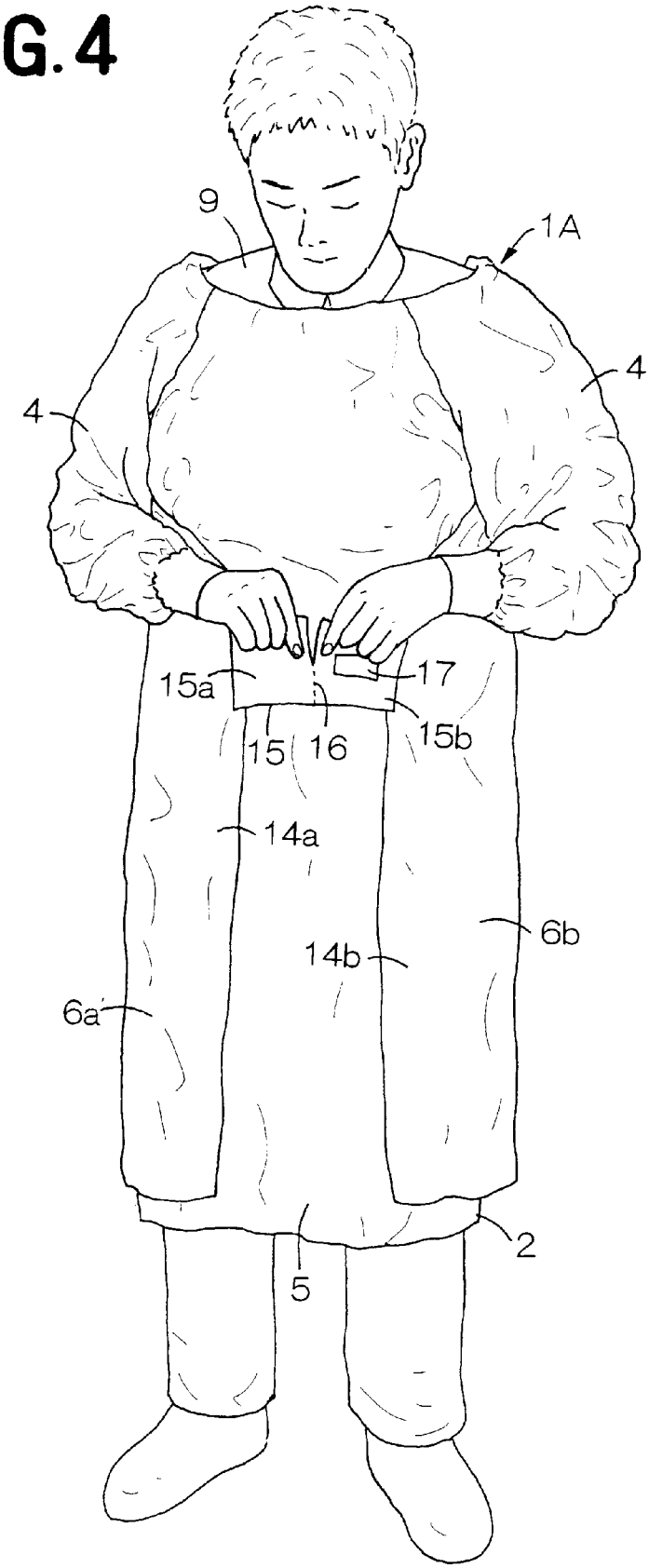
FIG. 4 is an explanatory drawing illustrating a sequence in which the gown of FIG. 1 is worn.
Figure 5:
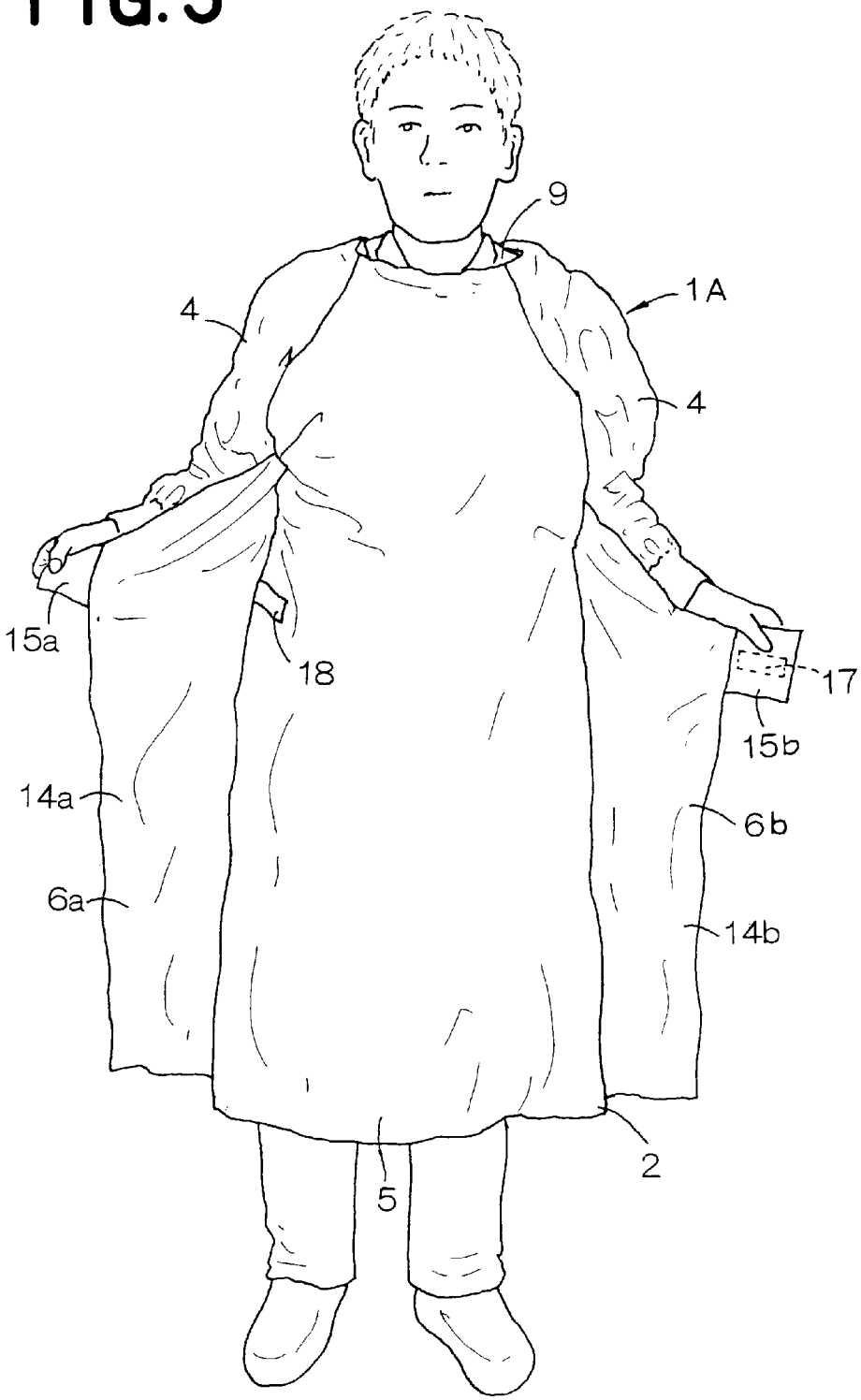
FIG. 5 is an explanatory drawing illustrating a sequence in which the gown of FIG. 1 is worn.
Figure 6:
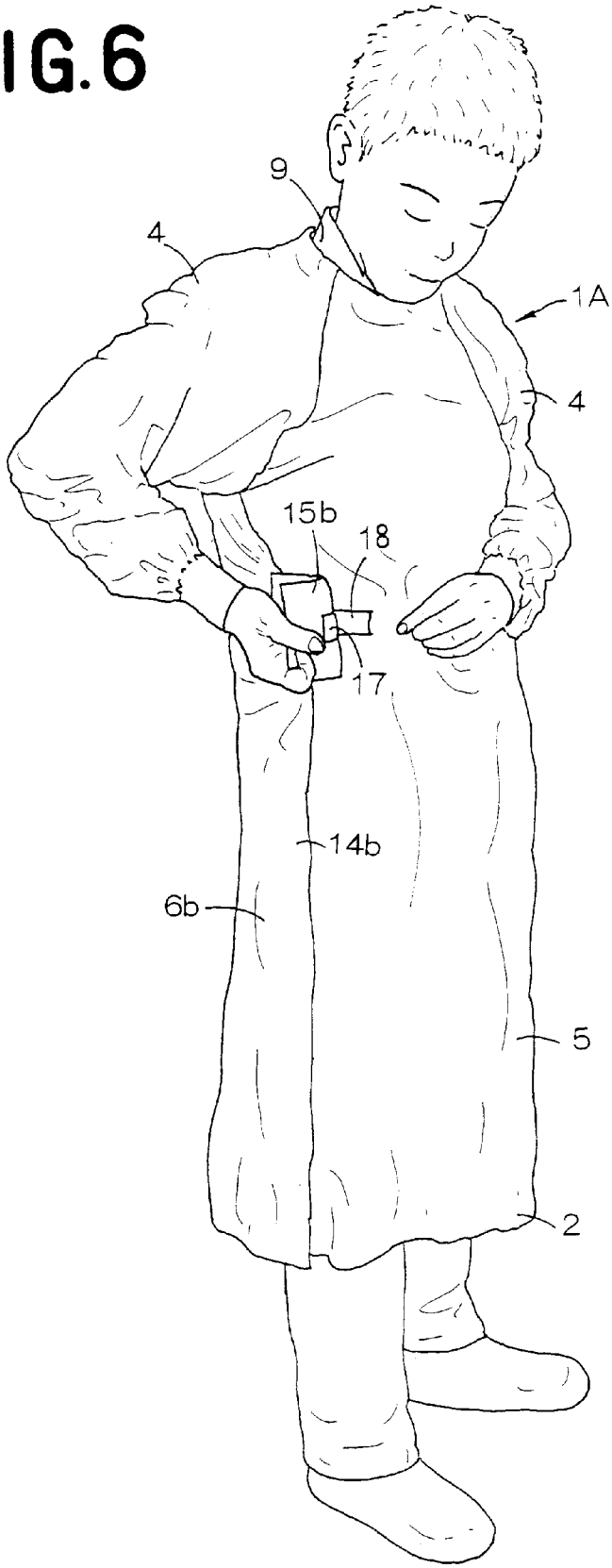
FIG. 6 is an explanatory drawing illustrating a sequence in which the gown of FIG. 1 is worn.

FIGS. 4, 5 and 6 are explanatory drawings illustrating a sequence in which the gown 1A of FIG. 1 is worn. To wear the gown 1A, a wearer may insert his or her arms into the sleeves 4 of the gown 1A, respectively, then hold the transversely opposite side regions 15*a*, 15*b* of the tape member 15 with the fingers to cut off the tape member 15 in two along the perforation 16 and separate these halves in the circumferential direction.

Holding the transversely opposite side regions 15*a*, 15*b* of the tape member 15 with the fingers, the wearer may unfold the first and second rear bodies 6*a*, 6*b* from the side of the front body 5 toward the backside as will be best seen in FIG. 5. Then, holding the side region 15*b* of the tape member 15 as will be best seen in FIG. 6, the wearer may place the free side edge region 14*b* of the second rear body 6*b* upon the outer surface of the free side edge region 14*a* of the first rear body 6*a* and engage the hook member 17 with the loop member 18 to close the backside. Thereafter, the wearer may engage the hook member 19 with the loop member 20 to close the neck hole 9.

Figure 7:
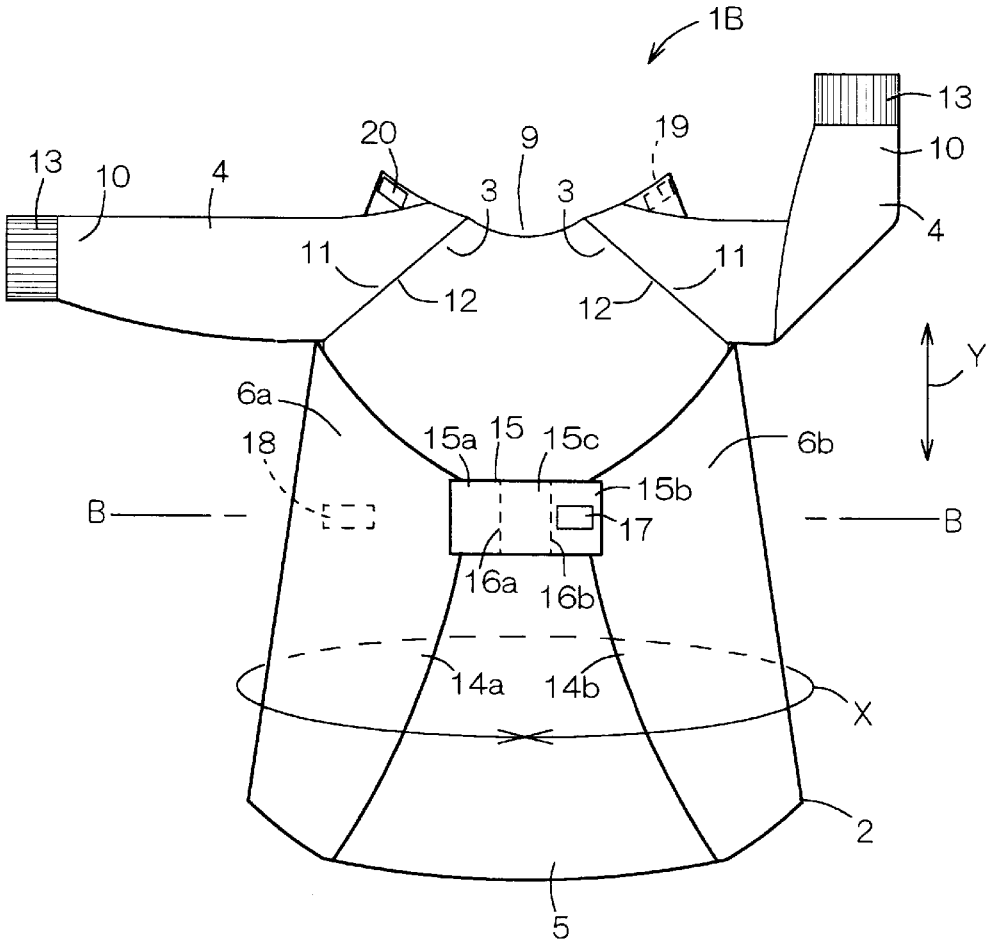
FIG. 7 is a perspective view showing another embodiment of the surgical gown as viewed from the side of its front body.
Figure 8:
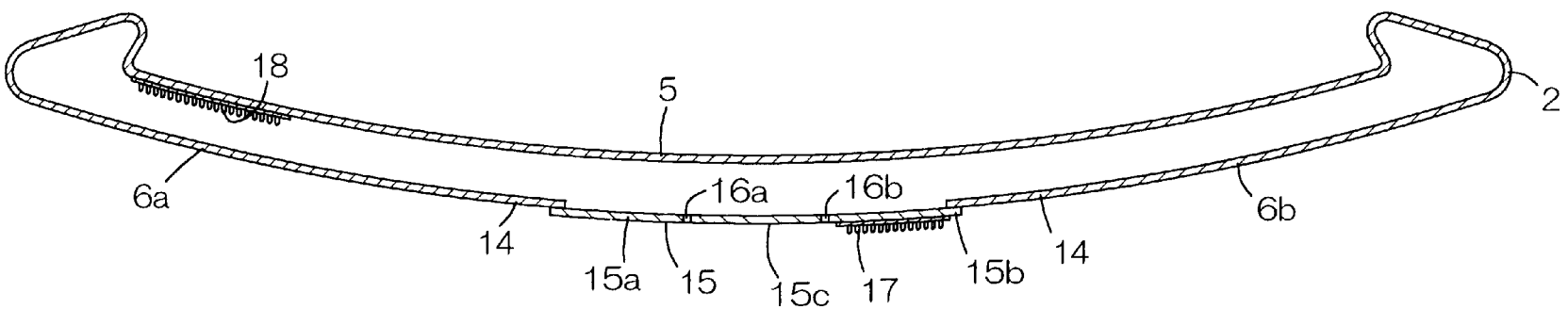
FIG. 8 is a cross-sectional view taken along a line B—B in FIG. 7.
Figure 9:
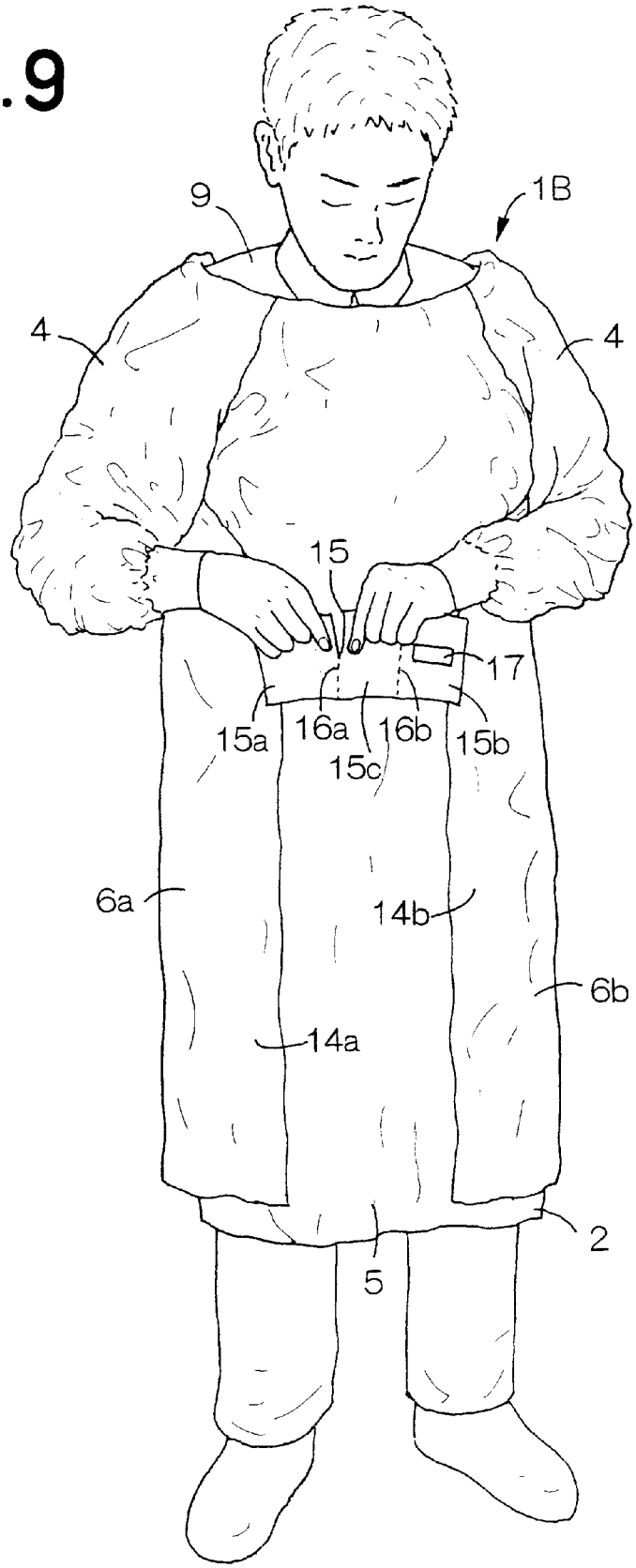
FIG. 9 is an explanatory drawing illustrating a sequence in which the gown of FIG. 6 is worn.
Figure 10:
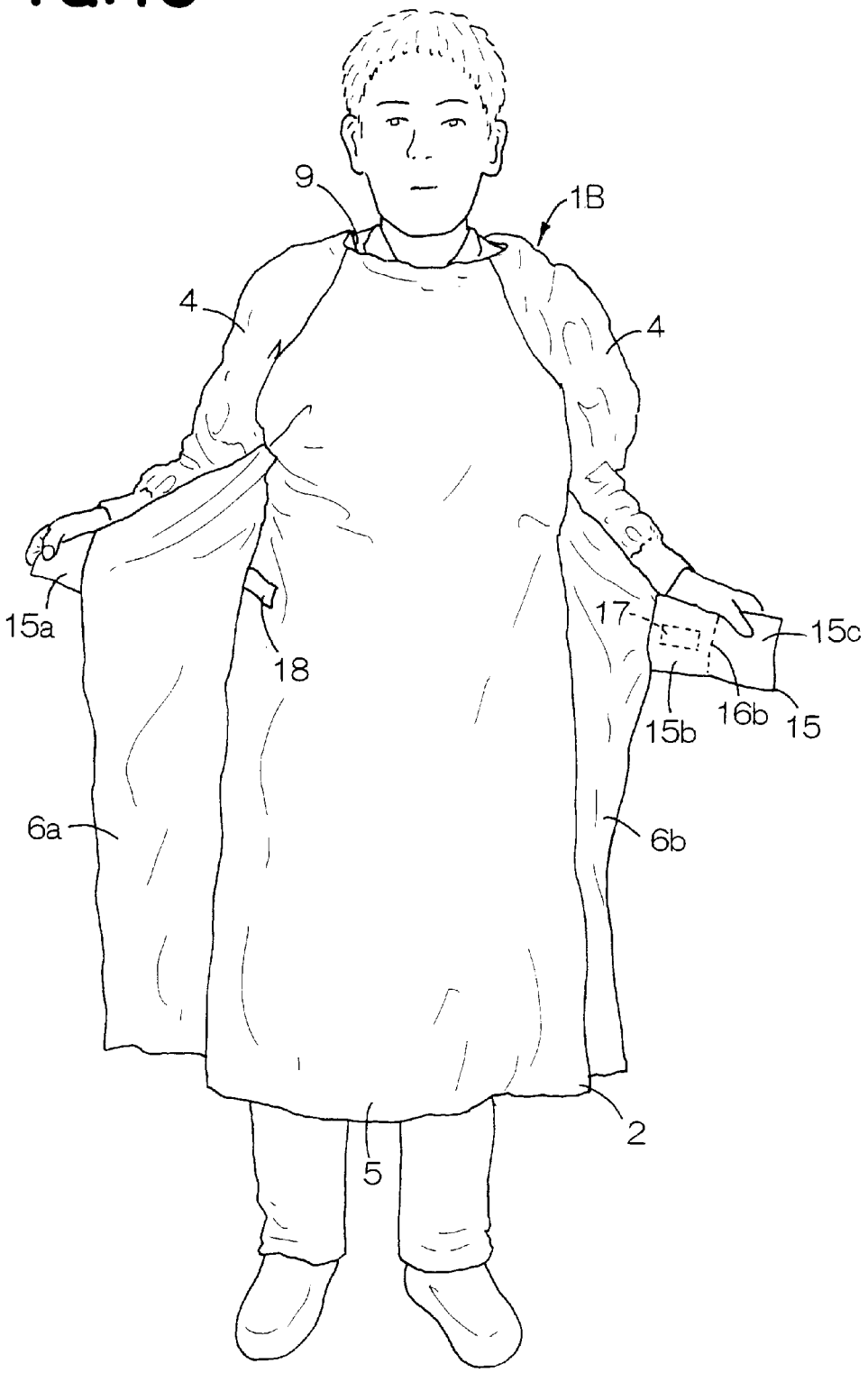
FIG. 10 is an explanatory drawing illustrating a sequence in which the gown of FIG. 6 is worn.

FIG. 7 is a perspective view showing another embodiment 1B of the surgical gown as viewed from the side of its front body 5 and FIG. 8 is a cross-sectional view taken along the line B—B in FIG. 7 with its wearer's body on the left side of the front body 5. The gown of FIG. 7 is similar to the gown of FIG. 1 except an arrangement as follows:

In the case of this gown 1B, the basic body 2 comprises the front body 5 and the first and second rear bodies 6*a*, 6*b* being integrally continuous one to another wherein the tape member 15 lies in the longitudinally middle zones of the free side edge regions 14*a*, 14*b* of the first and second rear bodies 6*a*, 6*b* and extends in the circumferential direction between the free side edge regions 14*a*, 14*b*.

The tape member 15 has transversely opposite side regions 15*a*, 15*b* lying adjacent to the free side edge regions 14*a*, 14*b* of the first and second rear bodies 6*a*, 6*b*, respectively, and a middle region 15*c* extending between the side regions 15*a*, 15*b*. The side regions 15*a*, 15*b* are partially bonded to the free side edge regions 14*a*, 14*b*, respectively. On both sides of the middle region 15*c*, a pair of perforations 16*a*, 16*b* extend in the longitudinal direction, along which the middle region 15*c* can be cut off from the side regions 15*a*, 15*b*.

FIGS. 9, 10, 11 and 12 are explanatory drawings illustrating a sequence in which the gown 1B is worn. To wear the gown 1B, a wearer may insert his or her arms into the sleeves 4 of the gown 1B, respectively, then hold the side region 15*a* and the middle region 15*c* of the tape member 15 with the fingers to cut off the tape member 15 in two along the perforation 16*a* as will be seen in FIG. 9. Then, holding the side regions 15*a*, 15*b* of the tape member 15 as will be seen in FIG. 10, the wearer may unfold the first and second rear bodies 6*a*, 6*b* from the side of the front body 5 toward the backside.

Figure 11:
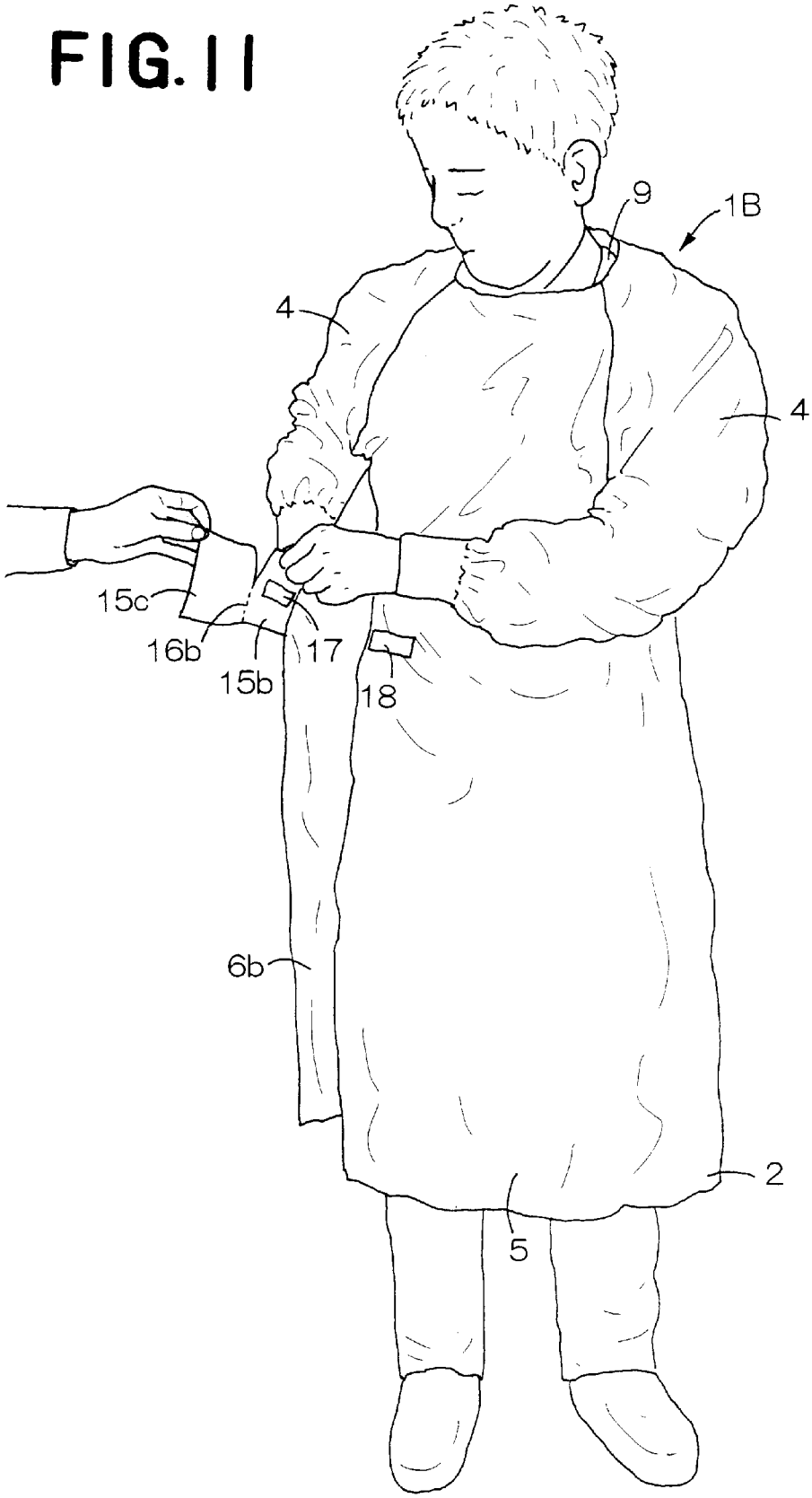
FIG. 11 is an explanatory drawing illustrating a sequence in which the gown of FIG. 6 is worn.

As seen in FIG. 11, the wearer may hand the middle region 15*c* cut off from the tape member 15 over to a helper who may then, holding the middle region 15*c* of the tape member 15 with the fingers, unfold the second rear body 6*b* toward the wearer's backside and make the wearer hold the side region 15*b* which is contiguous to the middle region 15*c*. The wearer and the helper cooperate each other to cut off the side region 15*b* and the middle region 15*c* held by them along the other perforation 16*b*.

Figure 12:
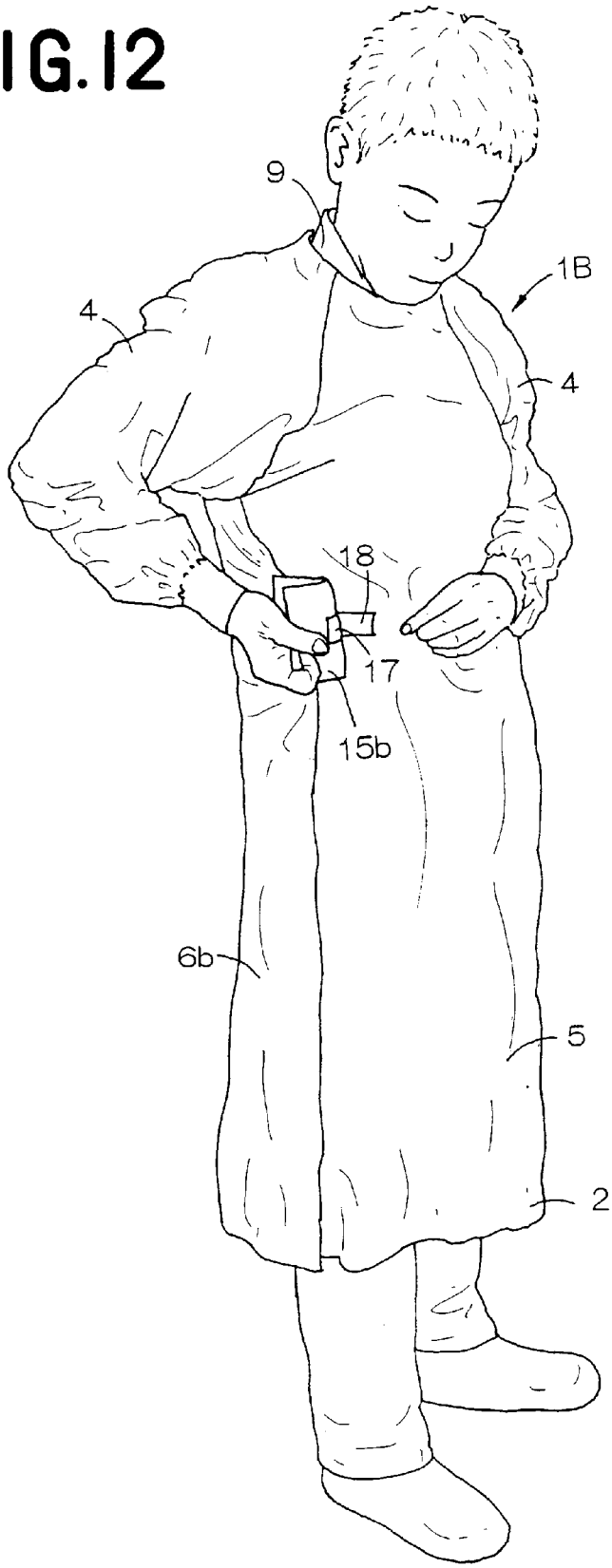
FIG. 12 is an explanatory drawing illustrating a sequence in which the gown of FIG. 6 is worn.

Holding the side region 15*b* of the tape member 15 as seen in FIG. 12, the wearer may place the free side edge region 14*b* of the second rear body 6*b* now lying on the backside upon the outer surface of the free side edge region 14*a* of the first rear body 6*a* and then engage the hook member 19 with the loop member 20 to close the neck hole 9. After this, the helper may engage the hook member 19 with the loop member 18 to close the backside. The middle region 15*c* of the tape member 15 having been cut off from the side regions 15*a*, 15*b* may be thrown away by the helper.

With these embodiments 1A, 1B of gown as illustrated, it is unnecessary for the wearer to develop the first and second rear bodies 6*a*, 6*b* in the circumferential direction so as to be spaced from each other when the wearer inserts the arms into the sleeves 4. This is for the reason that the backside of the basic body 2 has previously been opened in the circumferential direction.

Furthermore, both the gown 1A and the gown 1B are free from an anxiety that the outer surfaces of the front body 5 as well as the first and second rear bodies 6*a*, 6*b* might come in contact with clothes and skin of the wearer when the gown is worn. This is for the reason that, as will be apparent from FIGS. 1 and 7, the first and second rear bodies 6*a*, 6*b* are in advance folded back onto the front body 5, i.e., the respective outer surfaces of these rear bodies 6*a*, 6*b* face the outer surface of the front body 5 and the respective inner surfaces of them face outward of the gown 1A, 1B before the gown 1A, 1B is actually worn.

For these embodiments 1A, 1B of the gown, hydrophobic fibrous nonwoven fabric made of thermoplastic synthetic resin fiber, two-layered hydrophobic fibrous nonwoven fabric or a composite sheet comprising a flexible, air-pervious but liquid-impervious thermoplastic synthetic resin film sandwiched by hydrophobic fibrous nonwoven fabric may be used.

Nonwoven fabric may be selected from a group including products obtained by spun lace-, needle punch-, melt blown-, thermal bond-, spun bond- and chemical bond-process. It is also possible to use a composite nonwoven fabric comprising a melt blown nonwoven fabric having a high water-resistant property sandwiched by a spun bond nonwoven fabric having high strength and flexibility.

Component fiber of the nonwoven fabric may be selected from a group consisting of polyolefine-, polyester-, polyamide-based fibers and core-sheath-type or side-by-side conjugated fiber of polyethylene/polypropylene or polyethylene/polyester. It is also possible for the nonwoven fabric to be made mixed with cellulose-based fiber such as fluff pulp, rayon or acetate fiber.

As stock material for the tape member 15, a flexible plastic sheet made of polyethylene, polypropylene, polyethylene terephthalate, polyester.

Bonding of the front body 5 to the first and second rear bodies 6*a*, 6*b* as well as attachment of the tape member 15, the hook members 17, 19 and the loop members 18, 20 may be performed using hot melt adhesive or heat welding technique such as heat-sealing or ultrasonic sealing.

Depending on the wearers' body sizes, the gown 1A or 1B is provided in various sizes such as S, M, L, LL and, after packaged in sterilizing bag, subjected to a sterilizing process using gaseous organic chemicals or electron beam or radiation.

With the disposable surgical gown according to this invention, the tape member retains the gown in the state such that the first and second rear bodies have been folded back onto the front body (the backside of the basic body 2 has been opened in the circumferential direction) before the gown is actually worn. Therefore, it is unnecessary for the wearer to develop the first and second rear bodies in the circumferential direction so as to be spaced from each other when the gown is actually worn. Handling of the gown is correspondingly facilitated.

Furthermore, the gown is free from an anxiety that the outer surfaces of the front body as well as the first and second rear bodies might come in contact with cloths and skin of the wearer and be contaminated with various germs when the gown is worn. This is for the reason that the first and second rear bodies are folded back onto the front body 5 in advance prior to actual use of the gown.

What is claimed is:

1. A disposable surgical gown of back-closable type comprising:

a basic body composed of a front body, first and second rear bodies separated from each other in a circumferential direction with respect to a wearer's torso;

a pair of sleeves connected to a pair of shoulder regions of said basic body, respectively;

said gown being offered in a state prior to actual use thereof such that said first and second rear bodies are developed in said circumferential direction so as to be spaced from each other and folded back onto said front body so that respective free side edge regions of said rear bodies extend in a longitudinal direction lie on a side of an outer surface of an front body; and said free side edge regions being connected to each other by a tape member extending in said circumferential direction and having its transversely opposite side regions bonded to said free side edge regions at longitudinally middle zones of said free side edge regions wherein a perforation extends across said tape member in said longitudinal direction between said transversely opposite side regions so that said tape member is separated along said perforation in said circumferential direction.

2. The surgical gown according to claim 1, wherein said tape member has a transversely middle zone extending in said circumferential direction between said transversely opposite side regions and, on both sides of said middle zone, a pair of perforations extend in said longitudinal direction so that said middle zone is cut off from said transversely opposite side regions along said perforations.

3. The surgical gown according to claim 1, wherein said gown is provided with a female fastener member and a male fastener member adapted to be detachably engaged with each other to fasten said first and second rear bodies together and wherein said female fastener member is attached to said basic body at an appropriate location in its longitudinally middle region while said male fastener member is attached to one of the transversely opposite side regions of said tape member.

4. The surgical gown according to claim 2, wherein said female fastener member is one of a hook member and a loop member constituting together a mechanical fastener and said male fastener member is the other.

* * * * *